US008763198B2

(12) United States Patent
Thal

(10) Patent No.: US 8,763,198 B2
(45) Date of Patent: Jul. 1, 2014

(54) EDGE/CORNER ROLLER SYSTEM

(76) Inventor: James Thal, Deep River, CT (US)

( * ) Notice: Subject to any disclaimer, the term of this patent is extended or adjusted under 35 U.S.C. 154(b) by 254 days.

(21) Appl. No.: 13/398,359

(22) Filed: Feb. 16, 2012

(65) Prior Publication Data

US 2012/0210533 A1 Aug. 23, 2012

Related U.S. Application Data

(60) Provisional application No. 61/144,357, filed on Feb. 18, 2011.

(51) Int. Cl.
*B05C 17/02* (2006.01)

(52) U.S. Cl.
CPC ..... *B05C 17/0222* (2013.01); *B05C 17/0212* (2013.01); *B05C 17/0225* (2013.01)
USPC ..... 15/248.2; 15/230.11

(58) Field of Classification Search
CPC ..... B05C 17/0217; B05C 17/0225; B05C 17/0212; B05C 17/022; B05C 17/0232
USPC ..... 15/230.11, 248.2
See application file for complete search history.

(56) References Cited

U.S. PATENT DOCUMENTS

| | | | | |
|---|---|---|---|---|
| 2,680,318 | A * | 6/1954 | Simmons | 15/230.11 |
| 2,799,886 | A * | 7/1957 | Brunelli et al. | 15/248.2 |
| 2,994,899 | A * | 8/1961 | Moilanen | 15/244.2 |
| 7,096,530 | B2 * | 8/2006 | Goulet | 15/144.4 |
| 7,305,732 | B2 * | 12/2007 | Karroll | 15/230.11 |

* cited by examiner

*Primary Examiner* — Shay Karls
(74) *Attorney, Agent, or Firm* — Nixon & Vanderhye P.C.

(57) ABSTRACT

A paint roller includes a handle including a pair of spaced mounting arms, and a conical-shaped roller rotatably secured between the mounting arms. The conical-shaped roller facilitates an application of a coating such as paint or the like to a surface with an adjacent surface as close as a 45° corner.

14 Claims, 5 Drawing Sheets

View of Edge Roller Top Opposite Handle

View of Edge Roller Top Opposite Handle

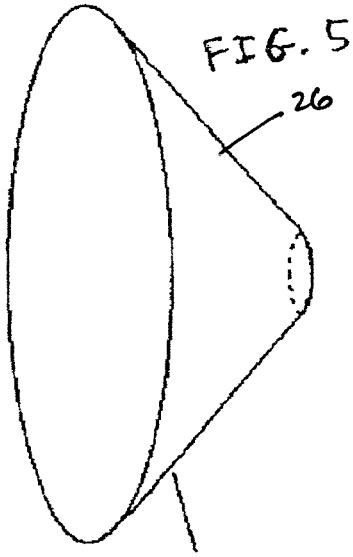
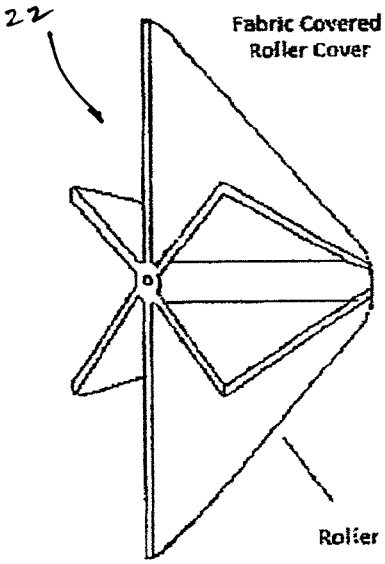
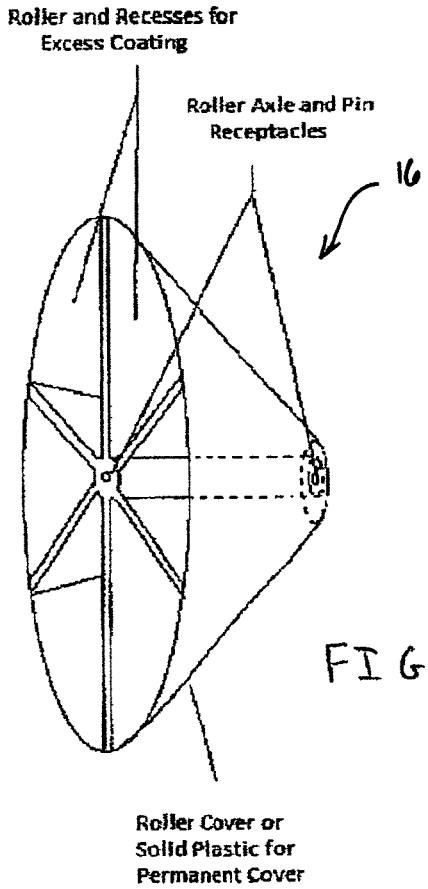
FIG. 6
Figure 7

EDGE/CORNER ROLLER SYSTEM

CROSS-REFERENCES TO RELATED APPLICATIONS

This application claims the benefit of U.S. Provisional Patent Application Ser. No. 61/444,357, filed Feb. 18, 2011, the entire content of which is herein incorporated by reference.

STATEMENT REGARDING FEDERALLY SPONSORED RESEARCH OR DEVELOPMENT (NOT APPLICABLE)

FIELD OF THE INVENTION

The present invention relates to a system for applying surface coatings to areas where two or more surfaces join each other such as corners, ceiling to wall or wall to trim where coating is required on only one of those joined surfaces. It is also capable of covering corners by application to each side of the corner.

BACKGROUND OF THE INVENTION

Conventional paint rollers are composed of two parts: a wire roller that freely spins on an axle as the roller moves across a surface, and a roller cover, which is a fabric-covered cylinder that slips onto the wire roller. The wire roller has a handle for the user to grasp. When attached to the wire roller, the roller cover is made to absorb the paint/coating from a reservoir, such as a paint pan. This absorbed coating is then applied to a surface by a rolling action. Currently, application of liquid surface coatings such as paint use a fabric covered roller to rapidly apply these coatings to surfaces. While these rollers work well on flat surfaces, they cannot be used to apply surface coatings in corners where two walls meet, where walls meet ceiling or where walls meet trim.

To overcome this limitation of conventional rollers a number of corner painting devices have been patented. These corner-painting rollers are of three basic types:

1. rollers which have the paint fabric solidly attached to the roller,
2. rollers wherein the fabric is not solidly attached to the roller, and
3. rollers that use adhesives to attach the fabric.

For rollers with fabric solidly attached, the roller is assembled with nuts and bolts, requiring tools for assembly, which may not be readily available. Additionally, the nuts and bolts tend to get covered with coating material and can fail to work properly. Disassembly can be difficult and messy, and the protruding nuts and bolts can damage the surface being coated.

With the corner painting roller where the fabric is not solidly attached to the roller cover, the fabric fits over the body of the roller, which is then attached to the roller axle. This is a two-step assembly process. When this roller is in use, the fabric is not anchored in place and can warp or become completely detached from the cover body marring the wall finish and resulting in messy cleanups.

The corner roller employing adhesives requires a multi-step assembly to apply dual fabric surfaces and application of the adhesive to the roller body. This reduces the flexibility of textures once the fabric is permanently affixed. In addition, this corner roller requires an adaptor to fit into a conventional paint pan.

All of the above are limited in that the coating would be transferred to both joined surfaces. In the case of painting the joint between wall and ceiling or wall and trim, the undesirable result would be coating transferred where not desired. These corner rollers are also limited to 90° or greater joints.

In addressing trim applications, two basic types have been patented:

1. a wheeled edge flat sponge pad or bristle surface, and
2. a roller with a paddle mounted so that it swivels into place on the edge of the roller, supposedly to protect the trim from being coated.

The flat pad trim applicator works well in protecting the trim from being coated, but the texture and finish do not match that of the roller normally being used on the rest of the surface.

The roller with the swivel barrier invariably becomes coated on the trim side with excess coating and transfers the coating to the surface not desired to be coated.

BRIEF SUMMARY OF THE INVENTION

It is an object of the preferred embodiments to overcome the aforementioned deficiencies. It is another object for applying coatings not only to corners as little as 45° but also to adjoining surfaces transferring the coating to only one of the surfaces joined using the conventional paint pan.

The system includes a roller of rigid material (plastic or metal) that freely spins on pins in the handle and a rigid fabric cover, as in a conventional roller but conical in shape, or a cover permanently affixed to the roller. Part of the handle is designed to skim off excess coating material from the roller as it turns and contain the coating material in the recesses of the roller. The roller snaps into the pins of the handle into the axle of the roller. Once the edge roller is loaded with the surface coating material, the coating can be applied up to edges of trim and ceiling as well as covering corners with ease and speed.

For the purposes of the present invention, the terms "paint" and "coating material" can be used interchangeably, without limiting the invention to either term.

In an exemplary embodiment, a paint roller includes a handle including a pair of spaced mounting arms, and a conical-shaped roller rotatably secured between the mounting arms. The handle may further include a skimmer connected to one of the spaced mounting arms, where the skimmer is positioned adjacent the conical-shaped roller. The skimmer may be flanged away from the roller.

The paint roller may further include a roller frame including angled spokes arranged in a circular array. A cover may be disposed over the roller frame, where the cover encloses and defines recesses between the angled spokes for excess coating material. In one arrangement, the cover is a plastic shell, and the paint roller further includes an absorbent surface material secured over the plastic shell. Preferably, the absorbent surface material is affixed to the plastic via an adhesive. In another arrangement, the cover may comprise an absorbent surface material.

Each of the spaced mounting arms may include an axle pin, where the conical-shaped roller is rotatably secured to the axle pins. In this context, the conical-shaped roller may include an axle and pin receptacles at ends thereof, where the pin receptacles receive the axle pins of the spaced mounting arms.

In another exemplary embodiment, a paint roller includes a handle with a pair of spaced mounting arms, and a star-shaped roller frame rotatably secured to the spaced mounting arms. The roller frame is tapered from a base side toward an apex side. A cover is disposed over the roller frame, where the cover and roller frame define a conical shape.

BRIEF DESCRIPTION OF THE DRAWINGS

These and other aspects and advantages of the invention will be described in detail with reference to the accompanying drawings, in which:

FIG. 5 shows a view of the roller cover;

FIG. 6 shows the roller with cover or the solid walled roller for a permanent roller cover;

FIG. 7 shows the roller frame upon which the roller cover (FIG. 5) is mounted.

DETAILED DESCRIPTION OF THE INVENTION

Figure 1:
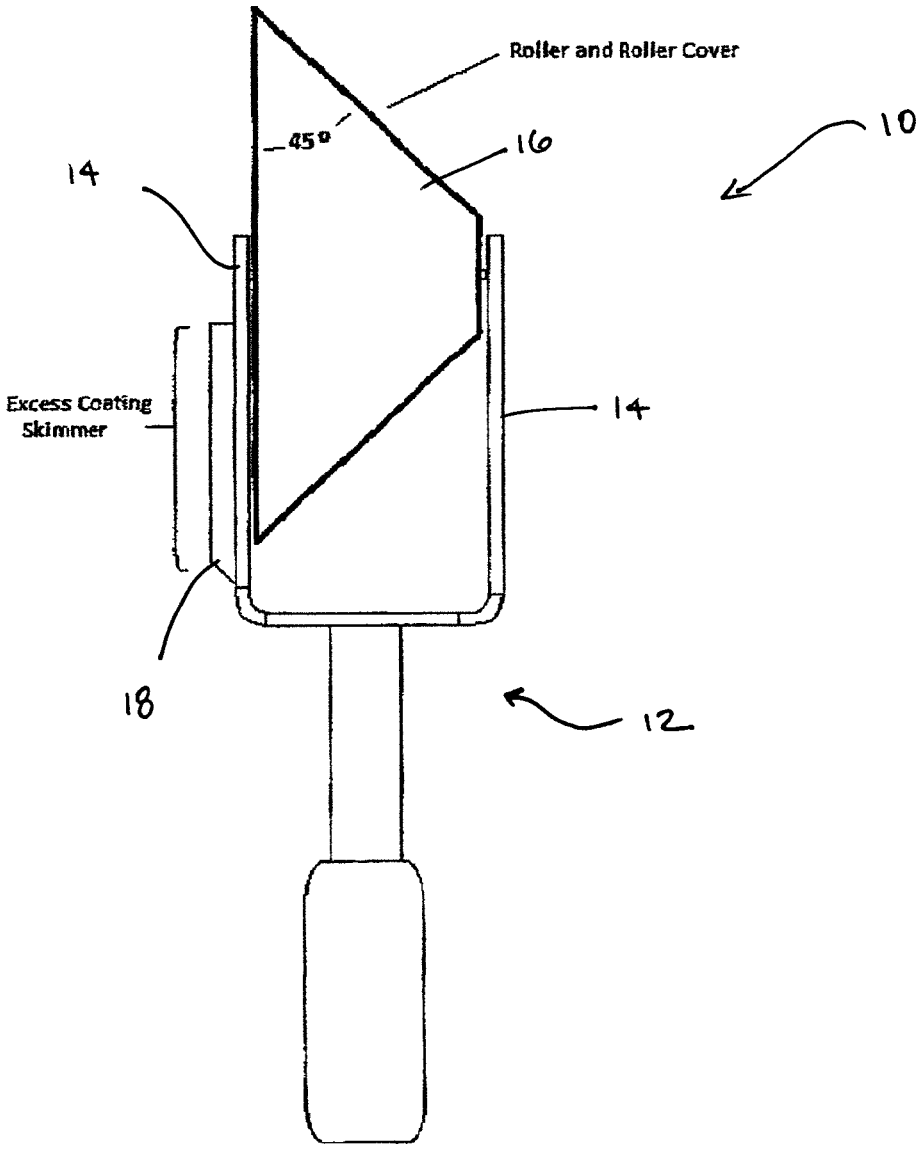
FIG. 1 shows a top view of the assembled edge roller.
Figure 2:
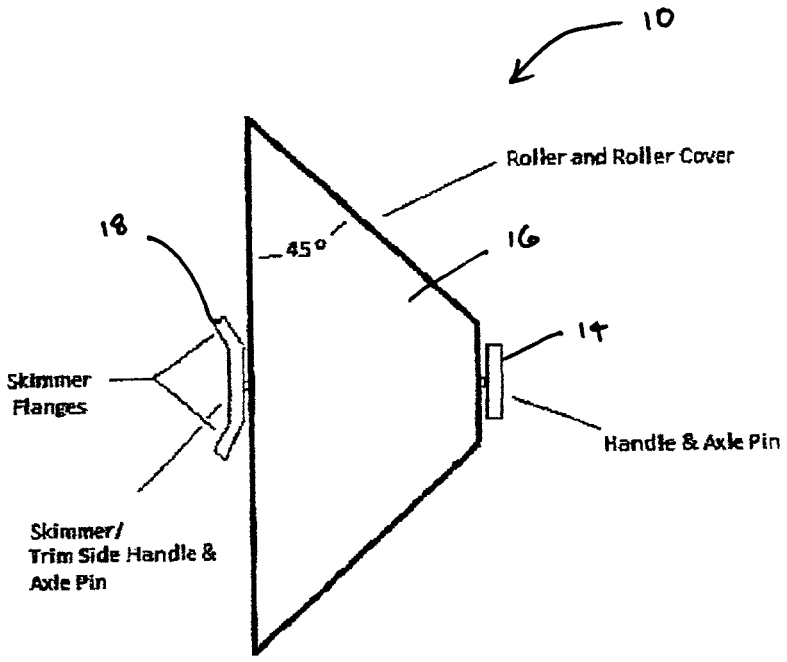
FIG. 2 shows the assembled edge roller looking at the roller from opposite the handle.

FIG. 1 shows the edge/corner roller 10 assembled as viewed from the user perspective with a handle 12 including a pair of spaced mounting arms 14. A conical-shaped roller 16 is rotatably secured to the spaced mounting arms 14. A conical angle of the roller 16 is preferably 45° as shown. A skimmer 18 is connected to one of the spaced mounting arms 14. As shown in FIG. 2, the skimmer 18 is flanged away from the roller 16. Preferably, the handle 12 and the roller 16 are made of a rigid material. Use of plastic makes the parts strong, lightweight and inexpensive.

FIG. 2 shows a view of the assembled edge roller 10 as seen from the roller with the handle opposite out of view. As shown, the flanged skimmer 18 guides excess coating material into the hollow core of the roller 16.

Figure 3:
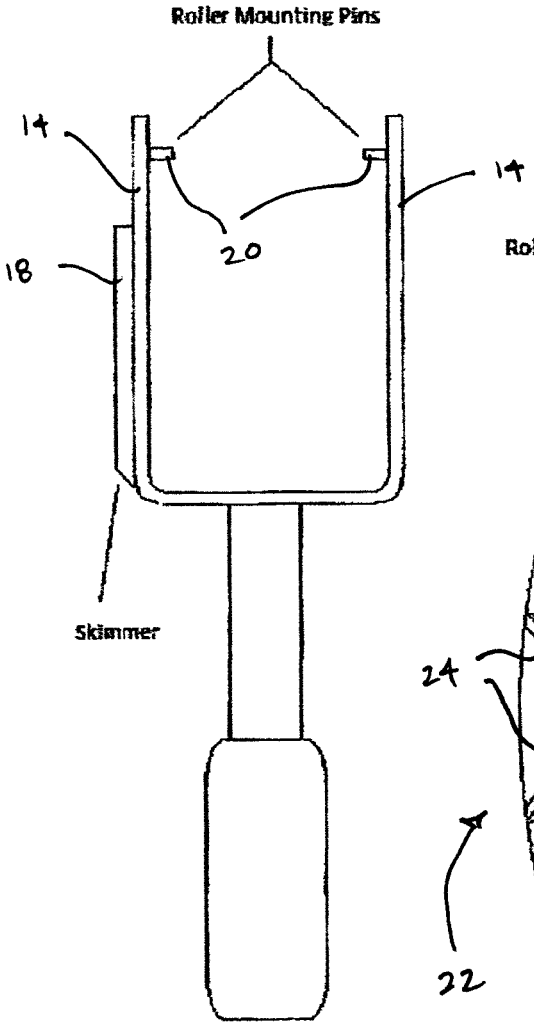
FIG. 3 shows the edge roller handle alone.

FIG. 3 shows the edge roller 10 unassembled. The handle 12 includes axle pins 20 for mounting the roller 16 on the handle 12 and acting as an axle to allow the roller 16 to rotate. The roller 16 includes pin receptacles 21 at ends thereof. The pin receptacles 21 receive the axle pins 20 of the spaced mounting arms 14. The mounting arms 14 are constructed of material that has sufficient spring to open for mounting the roller 16 and snapping back into place to secure the roller 16 snugly enough on the axle pins 20 to allow the skimmer 18 to rub the excess coating off the edge of a roller cover.

Figure 4:
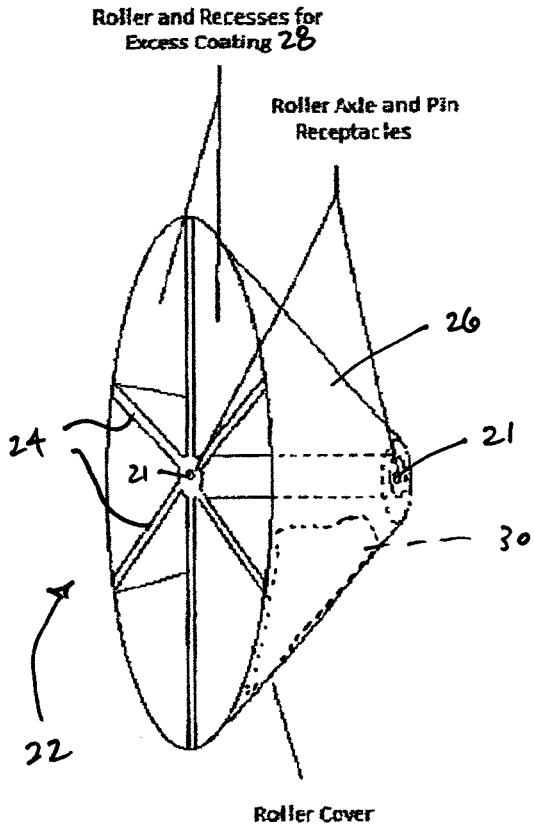
FIG. 4 shows the roller/roller cover assembly or the solid walled roller for permanent fabric cover.

FIG. 4 shows the construction of the roller 16. The roller 16 includes a roller frame 22 including angled spokes 24 arranged in a circular array as shown. The roller frame 22 tapers from a base side of the conical shape toward an apex side of the conical shape. A cover 26 is disposed over the roller frame 22 and encloses and defines recesses 28 between the angled spokes 24 for excess coating material. In one embodiment, the cover 26 is comprised of a plastic shell, and the paint roller includes an absorbent surface material 30 secured over the plastic shell. In this context, the absorbent surface material 30 may be affixed to the plastic via an adhesive. Alternatively, the cover 26 may be comprised of an absorbent surface material itself. The angled spokes 24 maintain strength of the roller 16 as well as providing separated recesses 28 for excess coating to be collected.

FIG. 5 shows the roller cover 26 made of the same or similar material as a conventional paint roller cover tube but constructed in the form of a cone to fit the star shaped roller frame 22 (FIG. 7). This provides for the flexibility to change the cover 26 to match the textures being used on the rest of the wall. FIG. 6 shows the roller cover 26 mounted on the star-shaped roller frame 22 or the solid shell roller 16 that accommodates a permanently mounted fabric.

Figure 8:
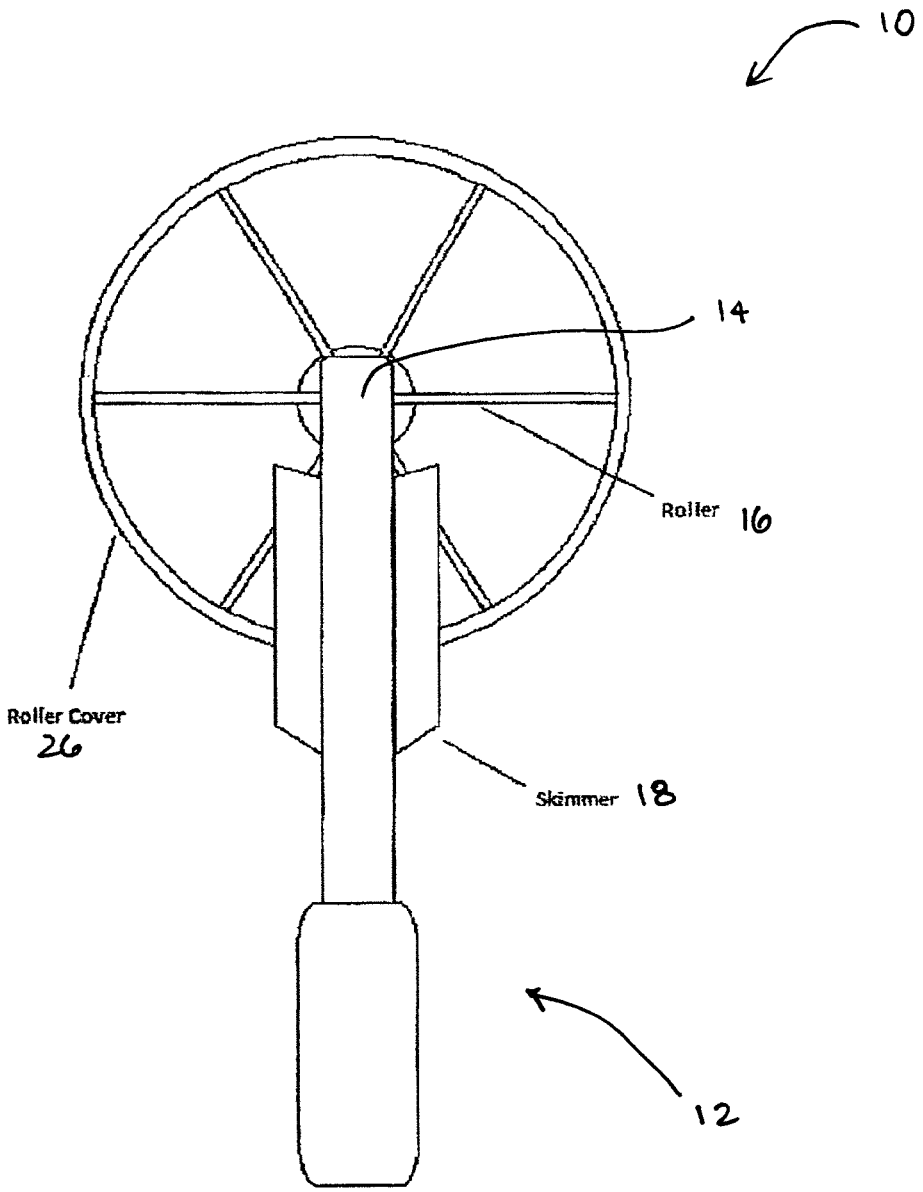
FIG. 8 shows a side view of the assembled edge/corner roller on the trim side for view of the excess coating skimmer and the recesses for excess coating material.

FIG. 8 shows a side view of the assembled edge roller 10 from the trim edge side. This drawing shows the flanged excess coating edge skimmer 18 and the recessed compartments 28 of the roller 16 that collect excess coating from the skimmer 18 and provide support for the roller cover 26.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A paint roller comprising:

a handle including a pair of spaced mounting arms; and a conical-shaped roller rotatably secured between the mounting arms, the conical-shaped roller including an open hollow core, wherein the handle further comprises a skimmer connected to one of the spaced mounting arms, the skimmer being positioned adjacent the conical-shaped roller and flanged away from the roller and configured to guide any excess coating material on the conical-shaped roller into the open hollow core.

2. A paint roller according to claim 1, further comprising a roller frame including angled spokes arranged in a circular array.

3. A paint roller according to claim 2, further comprising a cover disposed over the roller frame, the cover enclosing and defining recesses between the angled spokes for excess coating material.

4. A paint roller according to claim 3, wherein the cover comprises a plastic shell, the paint roller further comprising an absorbent surface material secured over the plastic shell.

5. A paint roller according to claim 4, wherein the absorbent surface material is affixed to the plastic via an adhesive.

6. A paint roller according to claim 3, wherein the cover comprises an absorbent surface material.

7. A paint roller according to claim 1, wherein each of the spaced mounting arms comprises an axle pin, and wherein the conical-shaped roller is rotatably secured to the axle pins.

8. A paint roller according to claim 7, wherein the conical-shaped roller comprises an axle and pin receptacles at ends thereof, the pin receptacles receiving the axle pins of the spaced mounting arms.

9. A paint roller according to claim 1, wherein a conical angle of the conical-shaped roller is 45°.

10. A paint roller comprising:

a handle including a pair of spaced mounting arms;

a star-shaped roller frame rotatably secured to the spaced mounting arms, the roller frame being tapered from a base side toward an apex side; and a cover disposed over the roller frame, the cover and roller frame defining a conical shape, wherein the roller frame comprises angled spokes arranged in a circular array, wherein the cover encloses and defines recesses between the angled spokes for excess coating material, and wherein the handle further comprises a skimmer connected to one of the spaced mounting arms, the skimmer being positioned adjacent the base side of the roller frame to guide the excess coating material into the recesses.

11. A paint roller according to claim 10, wherein the cover comprises a plastic shell, the paint roller further comprising an absorbent surface material secured over the plastic shell.

12. A paint roller according to claim 11, wherein the absorbent surface material is affixed to the plastic via an adhesive.

13. A paint roller according to claim 10, wherein the cover comprises an absorbent surface material.

14. A paint roller according to claim 10, wherein a conical angle of the conical shape is 45°.

* * * * *